US007270199B2

(12) United States Patent
Hall et al.

(10) Patent No.: US 7,270,199 B2
(45) Date of Patent: Sep. 18, 2007

(54) CUTTING ELEMENT WITH A NON-SHEAR STRESS RELIEVING SUBSTRATE INTERFACE

(76) Inventors: David R. Hall, 2185 S. Larsen Pkwy., Provo, UT (US) 84606; John V. Fernandez, 2185 S. Larsen Pkwy., Provo, UT (US) 84606

( * ) Notice: Subject to any disclaimer, the term of this patent is extended or adjusted under 35 U.S.C. 154(b) by 255 days.

(21) Appl. No.: 11/162,681

(22) Filed: Sep. 19, 2005

(65) Prior Publication Data

US 2007/0062737 A1 Mar. 22, 2007

(51) Int. Cl.
*E21B 10/573* (2006.01)

(52) U.S. Cl. ..... 175/432

(58) Field of Classification Search ..... 175/432
See application file for complete search history.

(56) References Cited

U.S. PATENT DOCUMENTS

| | | | | |
|---|---|---|---|---|
| 1,974,215 | A | 9/1934 | Kilmer | |
| 4,109,737 | A | 8/1978 | Bovenkerk | |
| 4,629,373 | A | 12/1986 | Hall | |
| 5,304,342 | A | 4/1994 | Hall | |
| 5,351,772 | A * | 10/1994 | Smith | 175/428 |
| 6,315,652 | B1 * | 11/2001 | Snyder et al. | 451/540 |
| 6,488,106 | B1 * | 12/2002 | Dourfaye | 175/428 |
| 6,527,069 | B1 * | 3/2003 | Meiners et al. | 175/432 |
| 6,739,417 | B2 * | 5/2004 | Smith et al. | 175/432 |
| 6,772,848 | B2 * | 8/2004 | Chaves | 175/432 |
| 7,108,598 | B1 * | 9/2006 | Galloway | 451/542 |
| 2003/0116361 | A1 * | 6/2003 | Smith et al. | 175/428 |
| 2004/0009376 | A1 * | 1/2004 | Wan et al. | 428/698 |
| 2006/0021802 | A1 * | 2/2006 | Skeem et al. | 175/432 |
| 2006/0065447 | A1 * | 3/2006 | Svendsen et al. | 175/432 |
| 2007/0017710 | A1 * | 1/2007 | Achilles et al. | 175/432 |

* cited by examiner

*Primary Examiner*—Hoang Dang
(74) *Attorney, Agent, or Firm*—Cameron Sneddon; Tyson J Wilde

(57) ABSTRACT

The present invention includes an improved cutting element substrate for cutting elements. The cutting element substrate includes non-planar, non-linear interfaces with an abrasive layer of superhard material affixed thereto often using a high pressure high temperature press apparatus. The cutting element substrate includes a cant intersecting a first and second interfacial surface. A plurality of truncated nodules intersects the first surface and extends towards the second surface. Arcuate segments protrude out of the second surface and are radially positioned along the surface. The truncated nodules are ill-aligned with the arcuate segments proximate the truncated nodules.

18 Claims, 9 Drawing Sheets

CUTTING ELEMENT WITH A NON-SHEAR STRESS RELIEVING SUBSTRATE INTERFACE

BACKGROUND OF THE INVENTION

The invention relates to an improved cutting element substrate having a cant intersecting a first and second interfacial surface. More particularly, the invention relates to cutting element substrates with non-planar, non-linear interfaces with an abrasive layer of super hard material affixed thereto often using a high pressure high temperature press apparatus. Cutting elements are useful as cutting inserts in drilling bits such as roller cone bits, rotary fixed cutter bits, earth boring bits, percussion bits or impact bits, and drag bits. Sometimes the cutting elements or inserts are defined by their geometric placement on a drill bit and by type of drill bit used. Some examples are heel and gage inserts. The cutting elements installed on a drill bit or other tool are used for earth or rock boring, such as may occur in the drilling or enlarging of an oil, gas, geothermal or other subterranean borehole, and to bits and tools so equipped. Additionally, other downhole tools are employed to cut or enlarge a borehole or which may employ superabrasive cutting elements or inserts. For example, such tools might include reamers, fishing tools, stabilizers, tool joints, wear knots and steering tools. There are also formation cutting tools employed in subterranean mining, such as drills and boring tools.

A typical rolling cone bit operates by the use of three rotatable cones oriented substantially transversely to the bit axis in a triangular arrangement, with the narrow cone ends facing a point in the center of the triangle which they form. The cones have cutting elements or inserts formed or placed on their surfaces. Rolling of the cones in use due to rotation of the bit about its axis causes the cutters to embed into hard rock formations and remove formation material by a crushing action. Percussion bits are used with boring apparatus known in the art that moves through a geologic formation by a series of successive impacts against the formation, causing a breaking and loosening of the material of the formation. Drilling bits are used to bore through a variety of geologic formations for oil, gas, and geothermal well exploration. A drag bit or fixed-cutter bit is designed to be turned in a clockwise direction (looking downward at a bit being used in a hole, or counterclockwise if looking at the bit from its cutting end about its longitudinal axis) about its longitudinal axis.

A cutting element, Polycrystalline Diamond Cutter(PDC) or an insert, typically has super hard material layer or table formed under high temperature and pressure conditions, usually in a press apparatus designed to create such conditions, to a cemented carbide substrate (such as cemented tungsten carbide) containing a metal binder or catalyst such as cobalt. The substrate is often less hard than the superhard material to which it is bound. Some examples of superhard materials that high temperature high pressure (HPHT) presses may produce and sinter include cemented ceramics, diamond, polycrystalline diamond, and cubic boron nitride. The cutting element may be mounted to a drill bit either by press-fitting or otherwise locking the substrate into a receptacle on a steel-body drag bit, or by brazing the cutter substrate directly into a preformed pocket, socket or other receptacle on the face of a bit body.

A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in a high pressure high temperature press apparatus. The substrates and adjacent diamond crystal layers are then compressed under HPHT conditions which promotes a sintering of the diamond grains to form the polycrystalline diamond structure. As a result, the diamond grains become mutually bonded to form a diamond table over the substrate face, which is also bonded to the substrate face.

Cutting elements are subject to intense forces, torques, vibration, high temperatures and temperature differentials during drilling and borehole formation. Drill bit stresses may be further aggravated by drilling anomalies during well bore formation such as bit whirl, spalling, delamination, or fracture of the abrasive layer or substrate often occurs thereby reducing or eliminating the cutting elements efficacy and decreasing overall drill bit wear life. The diamond layer of a cutting element sometimes delaminates from the carbide substrate after the sintering process and during percussive and abrasive use.

Damage typically found in these percussive and drag bits is a result of shear failures, although non-shear mode of failure are not uncommon. The interface between the diamond and substrate is particularly susceptible to non-shear failure modes. The failures may be mitigated by eliminating failure initiation points at the diamond-substrate interface.

BRIEF SUMMARY OF THE INVENTION

The present invention includes an improved cutting element substrate having a cant intersecting a first and second interfacial surface. The cant includes a plurality of truncated nodules intersecting the first surface and extending towards the second surface. The second interfacial surface includes a plurality of radially positioned protruding arcuate segments where the segments that are proximate to the truncated nodules are ill-aligned with each other.

Preferably the second surface has a least two concentric arcuate segment circles. In one embodiment of the invention, the second surface includes protruding truncated spheres instead of the arcuate segments. In another embodiment, the second surface includes truncated elliptical knobs. In each of these embodiments, the truncated spheres or elliptical knobs are preferably radially positioned. Preferably, some of the truncated spheres or elliptical knobs are also ill-aligned with the truncated nodules intersecting the first and second surfaces.

BRIEF DESCRIPTION OF THE DRAWINGS

The foregoing and other features of the present invention will become more fully apparent from the following description, taken in conjunction with the accompanying drawings. The invention will be described with additional specificity and detail through use of the accompanying drawings with the understanding that these drawings depict only typical embodiments in accordance with the invention and are therefore not to be considered limiting in scope.

DETAILED DESCRIPTION OF THE INVENTION AND THE PREFERRED EMBODIMENT

It will be readily understood that the components of the present invention, as generally described and illustrated in the Figures herein, may be arranged and designed in a variety of different configurations. Thus, the following detailed description of embodiments of the present invention, as represented in the Figures, is not intended to limit the scope of the invention, but is merely representative of various selected embodiments of the invention. The embodiments of the invention will be best understood by reference to the drawings wherein like parts are designated by like numerals throughout. Similar features are shown and referred to in each drawing by number, though not necessarily always described under the Figure heading below.

Figure 1:
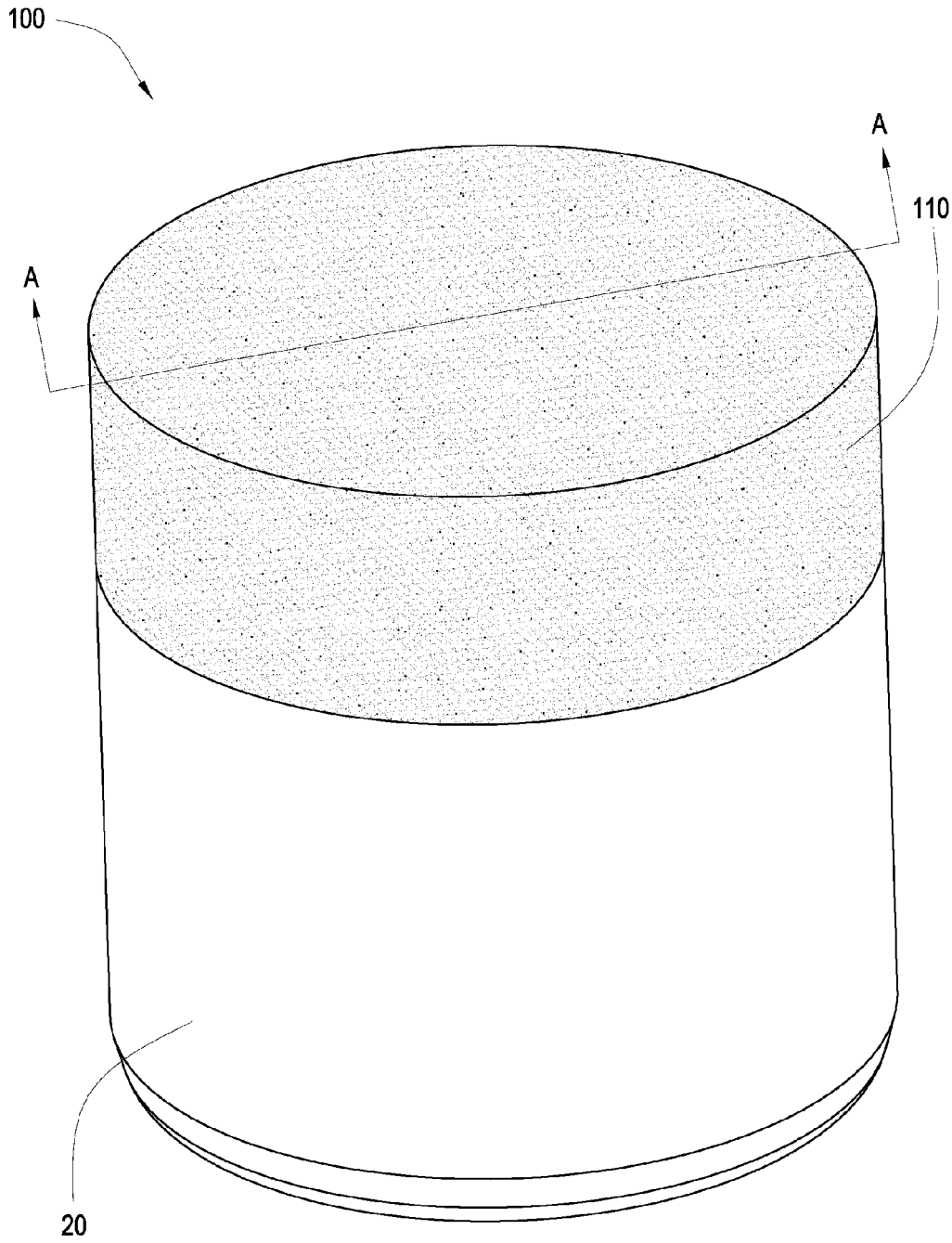
FIG. 1 is a perspective diagram of a cutting element.

Referring to the drawings, a perspective diagram of a cutting element 100 is shown in FIG. 1. The invention relates to cutting elements used in downhole drilling bits such as roller cone bits, rotary fixed cutter bits, earth boring bits, percussion bits or impact bits, and drag bits. Sometimes the cutting elements or inserts are defined by their geometric placement on a drill bit and by type of drill bit used. Drill bits are often used for earth or rock boring, such as may occur in the drilling or enlarging of an oil, gas, geothermal or other subterranean borehole, and to bits and tools so equipped. Typically, a cutting element 100 includes a super hard material layer or table formed under high temperature and high pressure conditions, usually in a high pressure, high temperature (HPHT) press apparatus designed to create such conditions, to a cemented carbide substrate (such as cemented tungsten carbide) containing a metal binder or catalyst such as cobalt. The substrate is often less hard than the superhard material to which it is bound. Some examples of superhard materials that HPHT presses produce and sinter include cemented ceramics, diamond, polycrystalline diamond, and cubic boron nitride. In a preferred embodiment of the invention, the superhard material layer 110 is preferably made of polycrystalline diamond. The cutting element substrate 20, to which the superhard material is bound, is preferably substantially cylindrical, conical or elliptical in shape.

Figure 2:
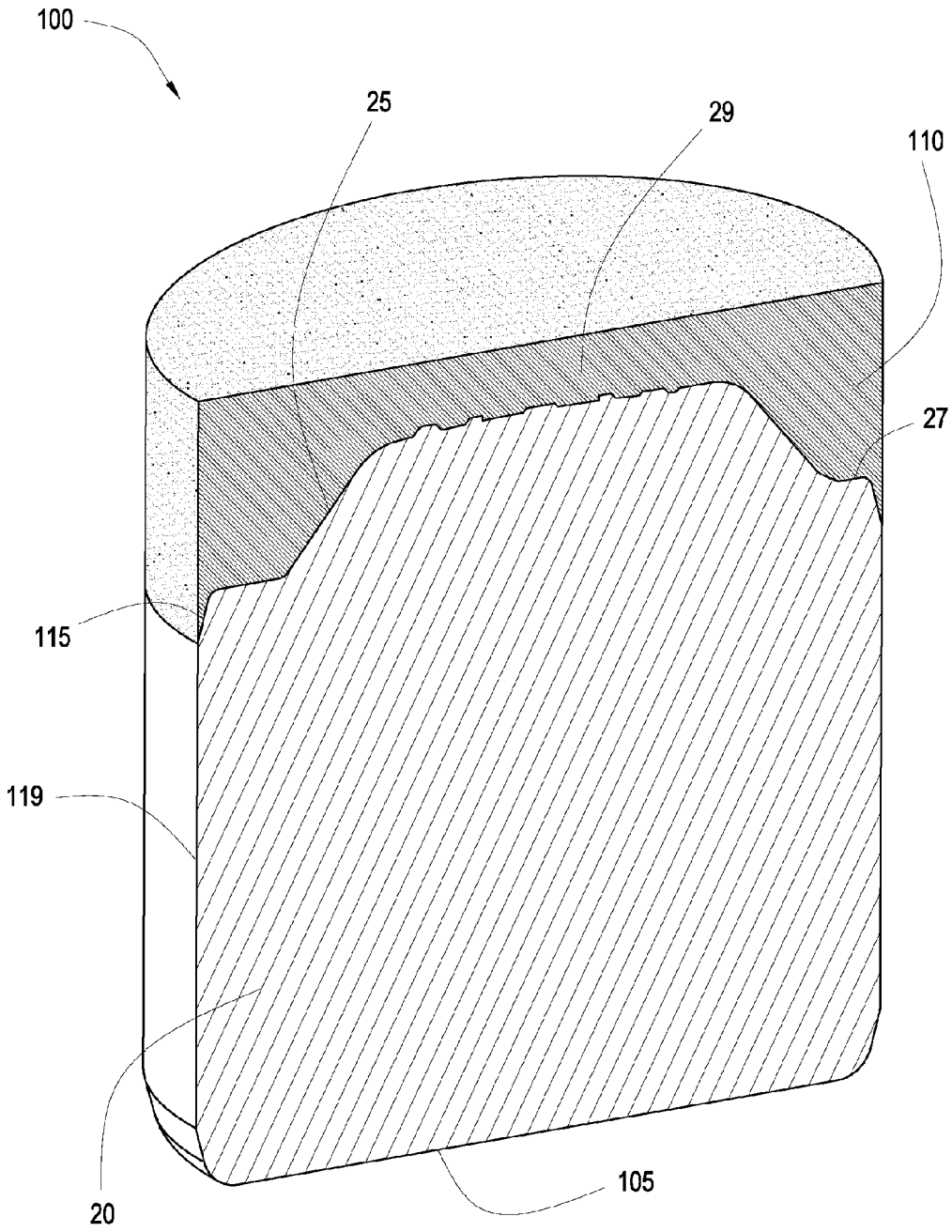
FIG. 2 is a cross-sectional diagram of the same cutting element as in FIG. 1 along the lines A-A.

FIG. 2 is a cross-sectional diagram of the same cutting element as in FIG. 1 along the lines A-A. The cutting element substrate 20 includes an inclined perimeter 115 which defines the circumferential transition surface between the first surface 27 and the outer diameter 119 of the cutting element substrate 20. Preferably, the superhard table 110 is formed on the first and second surfaces 27, 29 and extends from the second surface 29, along a cant 25 to the inclined perimeter 115. The surface upon which the superhard table is formed is non-planar. Surface 29 may be convex or semi-convex relative to the bottom face 105 of the substrate 20. The specific non-planar features of the superhard table-substrate interface will be detailed below.

As shown in FIG. 2, the superhard material interfaces directly with the substrate 20. In some embodiments it may be desirable for a transition layer to be intermediate the substrate 20 and the superhard material 110.

Figure 3:
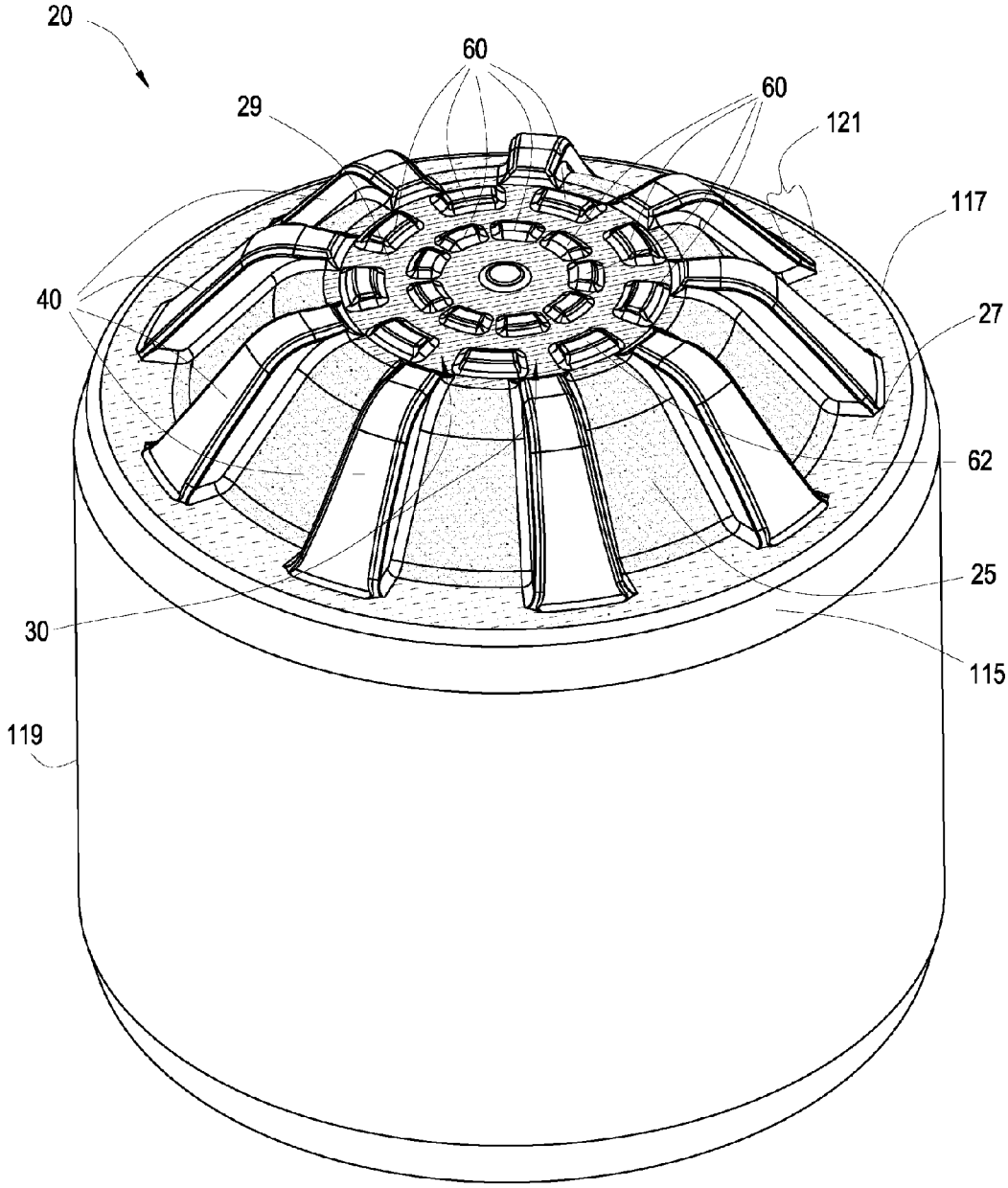
FIG. 3 is a perspective diagram of a cutting element substrate.

Turning now to FIG. 3, a perspective diagram of a cutting element substrate 20 is shown, including its non-planar features along the interfacial surfaces. Preferably, the superhard material 110 is bound directly to the interfacial surfaces, such that an imprint of the interfacial surfaces as shown in FIG. 3 is formed in the superhard material 110. The cutting element substrate 20 includes a cant 25 intersecting a first interfacial surface 27 and a second interfacial surface 29. Below the first surface 27 is the inclined perimeter 115 which serves as a transition from the first surface 27 to the outer diameter 119 of the cutting element substrate 20. The inclined perimeter 115 preferably includes a bevel 117. The cant 25 comprises a plurality of truncated nodules 40 intersecting the first surface 27 and extending towards the second surface 29. Preferably the truncated nodules 40 are equidistant from each other when formed along the cant. The truncated nodules 40 preferably do not fully extend to the bevel 117 and may form an offset 121 from the bevel 117. This creates a shoulder area resulting in a thick fracture resistant lip of superhard material that further supports the superhard table and prevents delamination or spalling.

The second surface 29 comprises a plurality of radially positioned protruding arcuate segments 60. Preferably, the protruding arcuate segments 60 form a "fingerprint pattern" which will be discussed in detail later. Some of the arcuate segments 60 are proximate the truncated nodules 40, for example arcuate segment 62. Preferably, the arcuate segments 60 proximate the truncated nodules 40 are ill-aligned with each other thus forming a gap 30 between the arcuate segments 60 and truncated nodules 40.

Figure 4:
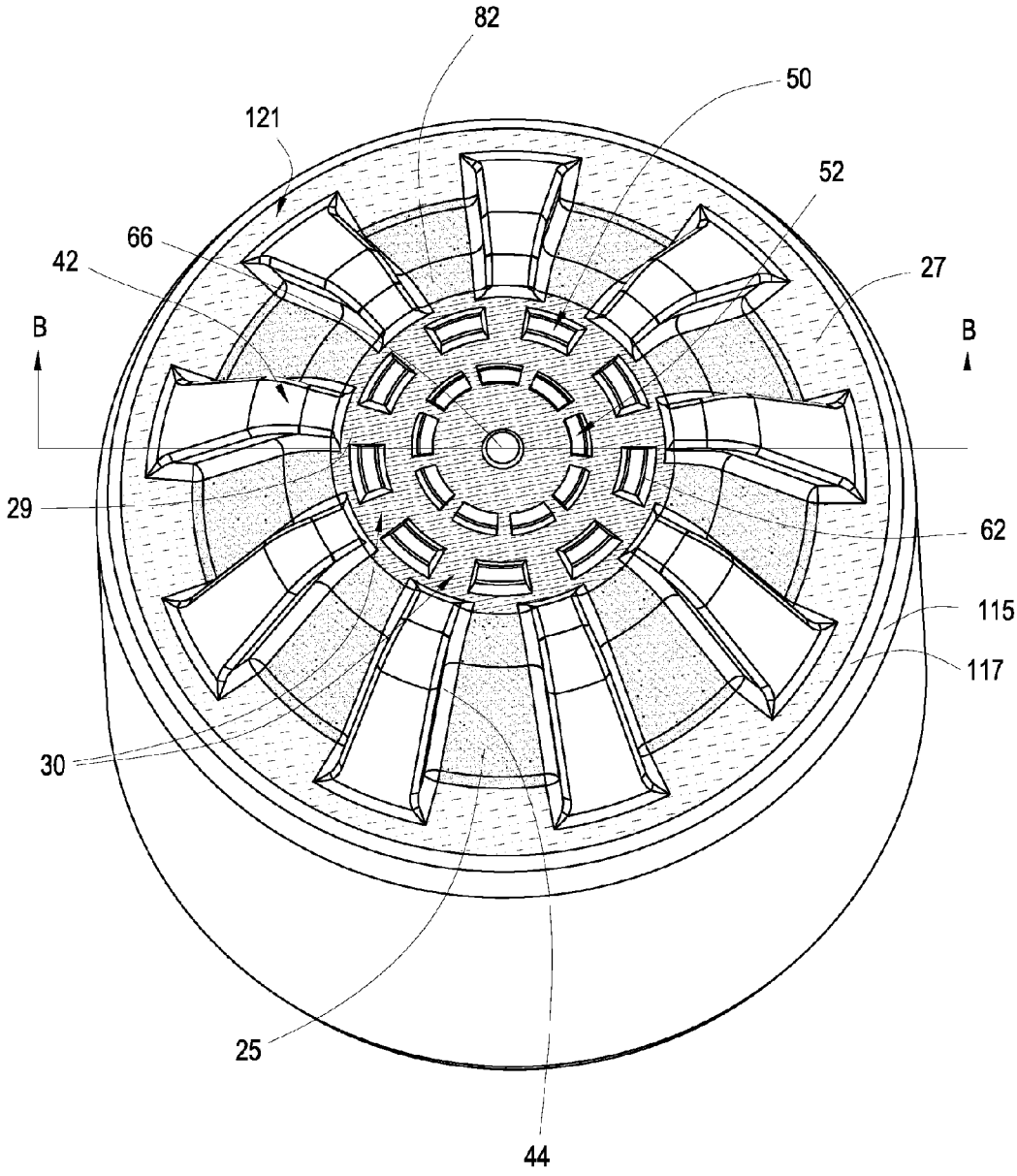
FIG. 4 is a perspective diagram from the top of the cutting element substrate and the non-planar surface.

FIG. 4 is a perspective diagram from the top of the cutting element substrate and the non-planar surface. Like features have like numbers in the figures. The first interfacial surface 27 becomes a "shouldering type" surface for the superhard material to form and impart strength to the superhard material layer. Preferably an offset 121 is formed between the truncated nodules 40 and the bevel 117. If a cutting element substrate has no bevel 117, then the offset may alternatively be between the truncated nodules 40 and the inclined perimeter 115. The cant 25 preferably forms a slight curvature 82 as it extends toward the second surface 29. Preferably the curvature 82 is near the upper portion of the cant 25. The truncated nodules 40 preferable cambers 42 somewhat toward the second surface 29. The transition from the cant 25 to the truncated nodule 40 is preferably a gentle concave curve 44 so that no sharp points along the transition surface become stress inducing point or stress riser during normal use of the cutting element.

The "fingerprint pattern" of the non-planar second interfacial surface 29 preferably includes two concentric circles 50, 52 of protruding arcuate segments. The outer circle 50 of arcuate segments is proximate the truncated nodules 40 and the segments are ill-aligned with each other. The arcuate segments in the outer and inner circles 50, 52 may also be substantially ill-aligned in certain embodiments depending on the spacing between each arcuate segment within the inner circle 52. Complete and total ill-alignment of the arcuate segments 60 and truncated nodules 40 may be not necessary. As is seen in the diagram, some overlap of a segment and a truncated nodule is depicted, such overlap depends on the arcuate segment length and spacing between the truncated nodules. Preferably though, features of the non-planar interfaces are substantially ill-aligned. A gap 30 may be formed between each arcuate segment 60 in the outer circle 50, between the truncated nodule 40, and between the arcuate segments of the inner circle 52 due to ill-alignment of the outer circle 50. A center protruding knob 66 may be situated within the inner circle 52 and may generally form the apex of the second surface 29.

The non-planar interface takes into account problems with delamination of the substrate after the superhard material is sintered in place, such as non-shear modes of failure. The present invention creates low stress regions and does not have stress concentrations that are thought to induce delamination. The design consists on a fingerprint-type pattern at the second interfacial surface and truncated nodules on the cant such that the truncated nodules are offset from the main substrate outer diameter, resulting in a thick fracture resistant diamond lip. The "fingerprint pattern" consists of protruding arcuate segments that are ill-aligned relative to each other radially as well as in the angular direction creating a staggered pattern. The new fingerprint design creates a staggered pattern resisting motion radially as well as angularly which, it is believed, ensures the maximum distortion of the second interfacial surface. The interfacial surfaces rely on a "bend but do not break" principle, it is believed, by allowing some distortion to help alleviate stresses induced during percussive and abrasive use, yet not imparting excessive strength and stiffness to the substrate and superhard layer interface such that the superhard layer easily delaminates, fractures or spalls.

Figure 5:
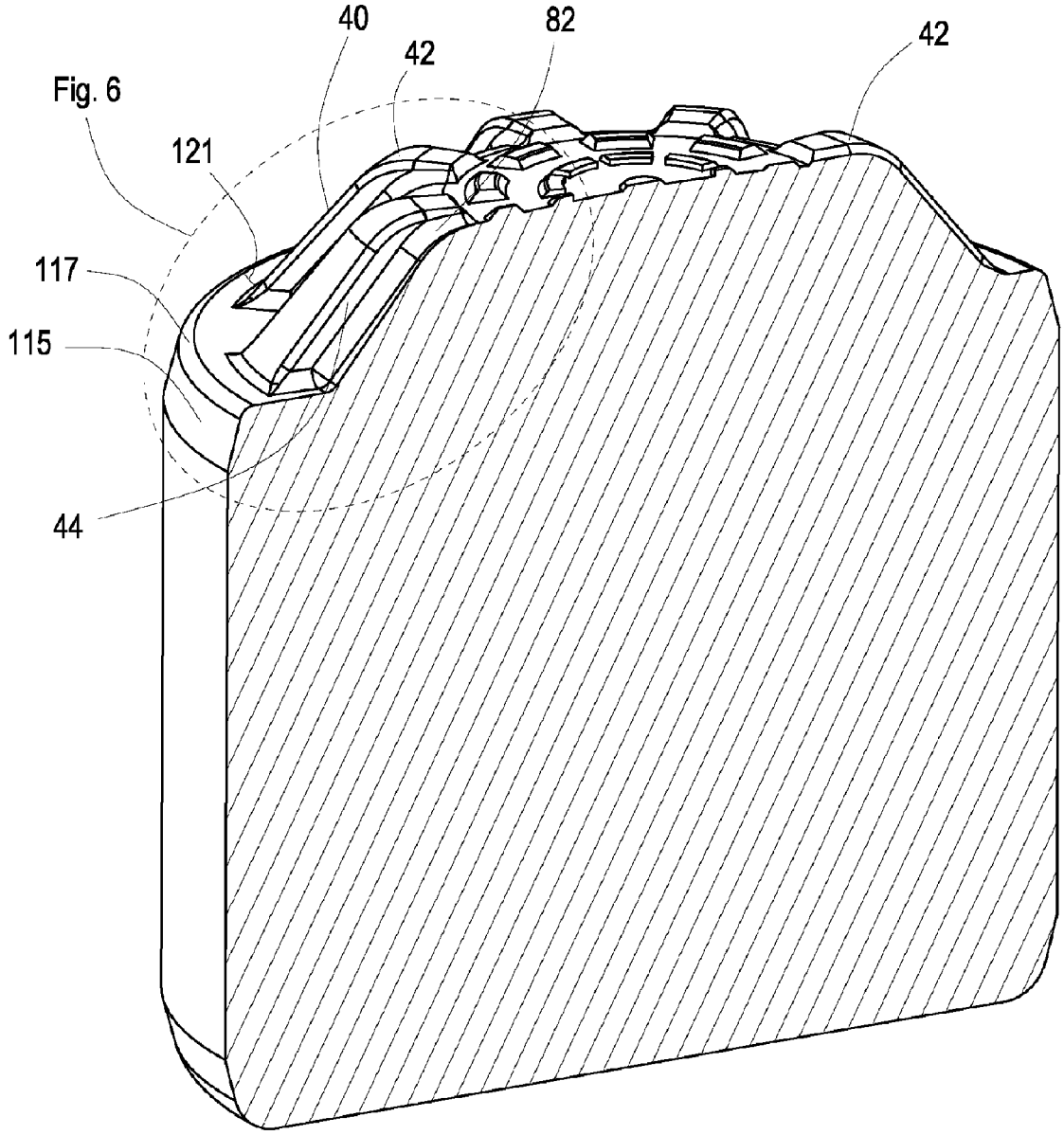
FIG. 5 is a cross-sectional diagram of FIG. 5 along the lines B-B.

FIG. 5 is a cross-sectional diagram of FIG. 4 along the lines B-B. Preferably an offset 121 is formed between the truncated nodules 40 and the bevel 117. If a cutting element substrate has no bevel 117, then the offset may alternatively be between the truncated nodules 40 and the inclined perimeter 115. The cant preferably forms a slight curvature 82 as it extends toward the second surface 29. Preferably the curvature 82 is near the upper portion of the cant 25. A camber 42 is formed as the truncated nodules 40 extend toward the second surface 29 as the truncated nodules 40 intersect both the second surface 29 and first surface 27. Preferably a gentle concave curve 44 forms the transition between the cant 25 and the truncated nodule 40. Reducing stress risers is a desired feature in cutting element substrate design and it is believed that the gentle transitions between the non-planar features along the interfacial surfaces reduces the number of high stress points between the superhard table and cutting element substrate.

The cutting element substrate is preferably made from cemented metal carbide, most preferably tungsten carbide. Other possible materials from which the substrate may be made include silicon carbide, titanium carbide, and cubic boron nitride. Preferably the substrate has a substantially cylindrical shape but may also be conical or elliptical. In some embodiments, the interfacial surface may be substantially conical with the remaining portion of the substrate being substantially cylindrical.

Figure 6:
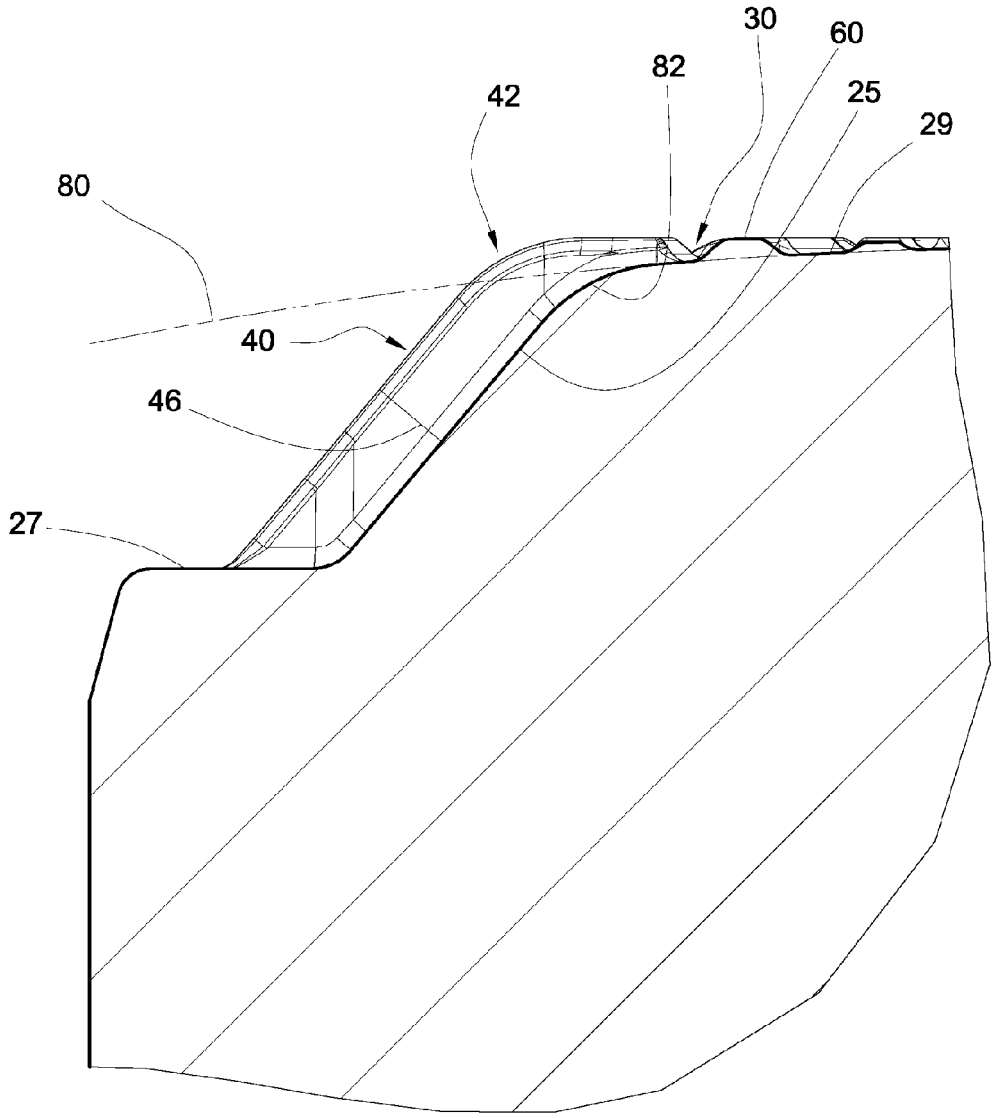
FIG. 6 is a detailed cross-sectional diagram of a cutting element substrate.

FIG. 6 is a detailed cross-sectional diagram of the interfacial surfaces of a cutting element substrate. Line 80 represents the sloped nature of the second interfacial surface 29, which forms an apex generally at the center protruding knob (see FIG. 4). The protruding nodules 40 intersecting the first surface 27 and second surface 29 preferably have a camber 42 which is preferably near or a part of the transition from the protruding nodule 40 to the second interfacial surface 29. The protruding nodule 40 may extend beyond the second interfacial surface 29. The ill-aligned pattern of the protruding nodules 40 and arcuate segments 60 form a gap 30 between the arcuate segments 60 and protruding nodules 40. This feature, it is believed, allows for the "fingerprint pattern" to cleat the superhard table and help prevent delamination, fracture, and spalling during percussive and abrasive use, especially for non-shear stresses. The protruding nodule pitch 46 may vary depending on the desired application and superhard material sintering process.

Figure 7:
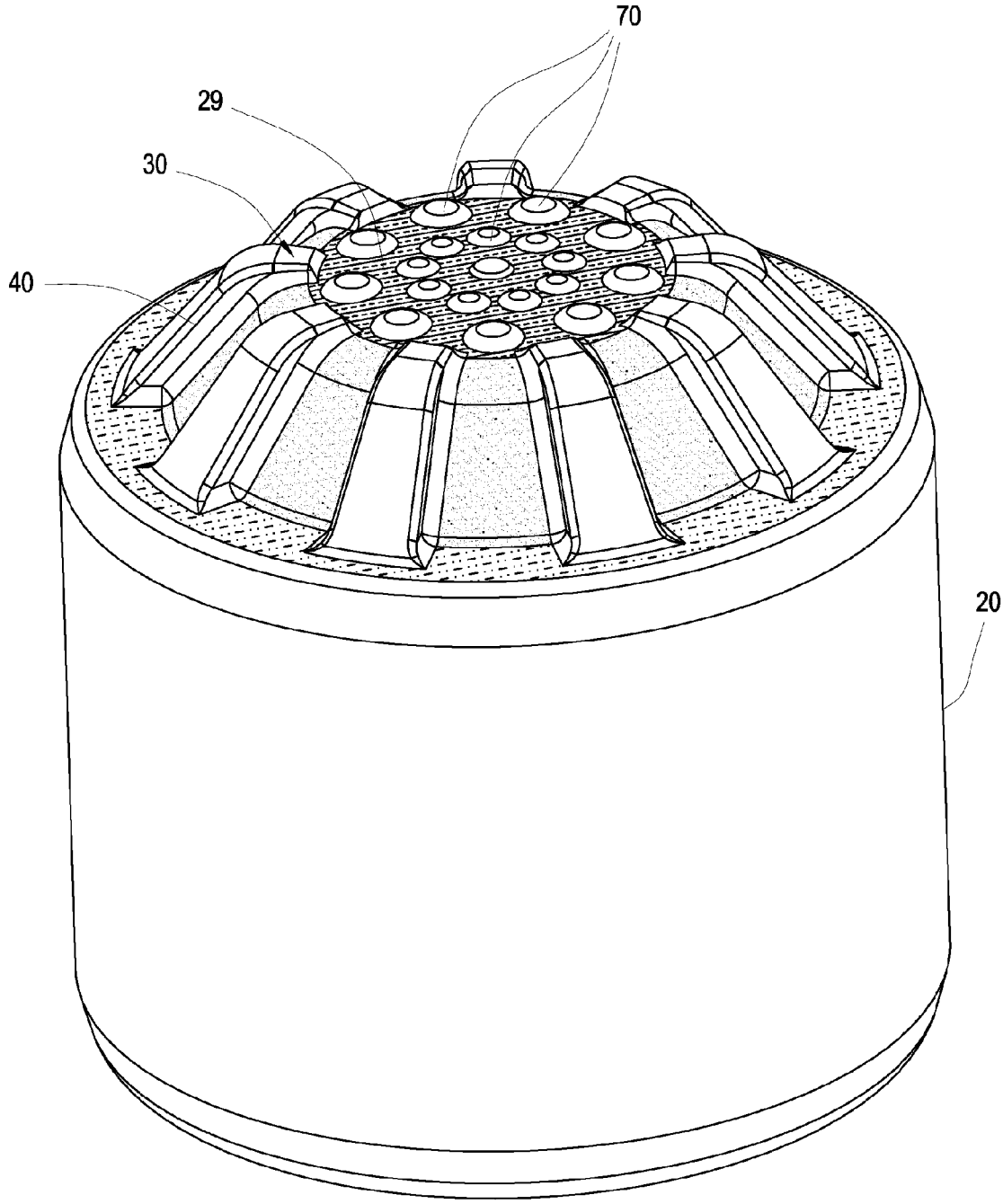
FIG. 7 is a perspective diagram of another embodiment of the invention showing protruding truncated spheres.
Figure 8:
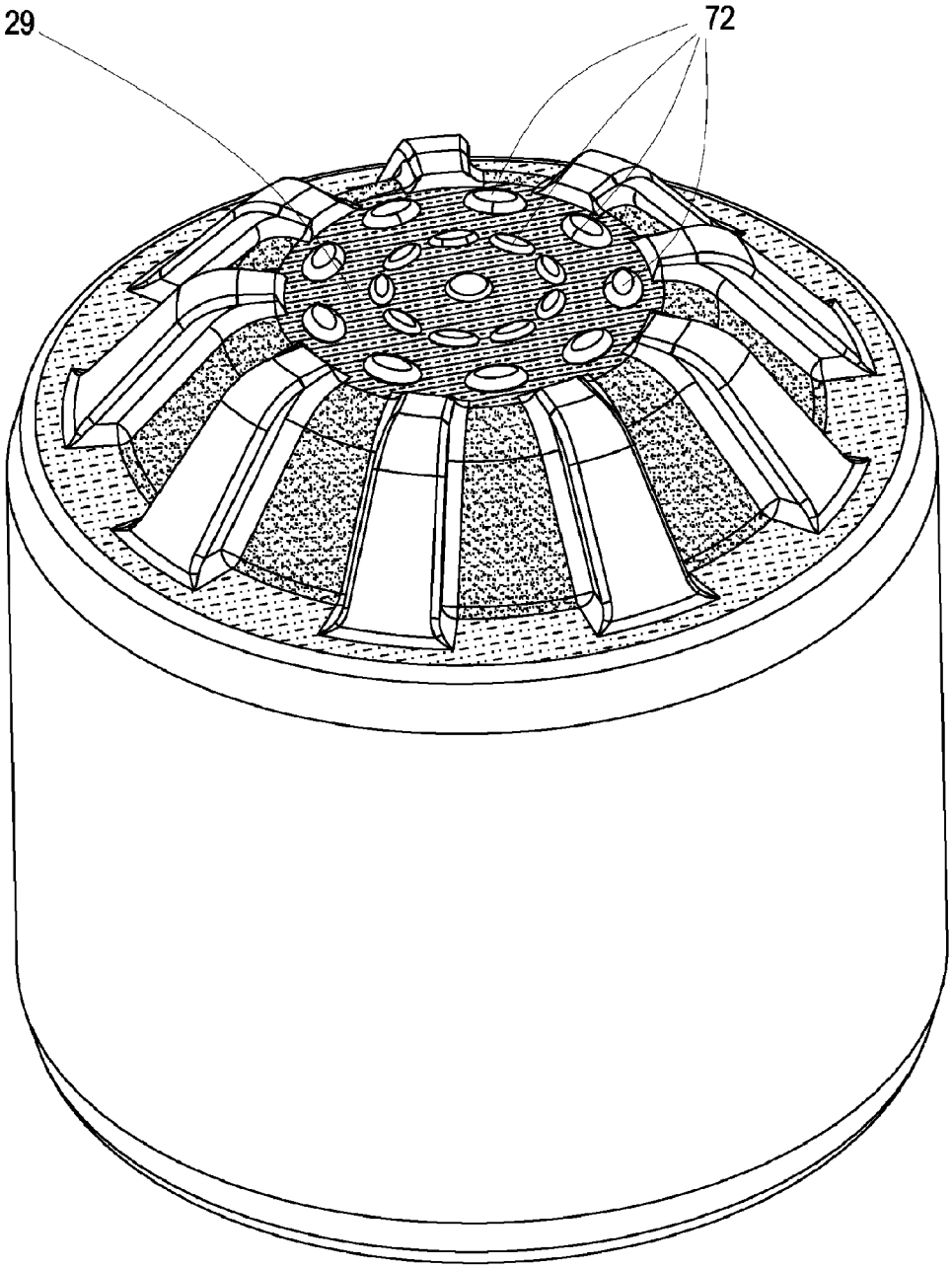
FIG. 8 is a perspective diagram of anther embodiment of the invention showing protruding truncated elliptical knobs.

Turning now to FIGS. 7-8, different "fingerprint patterns" are depicted in different embodiments of the invention. In each of the drawings like numbers depict like components unless otherwise noted. FIG. 7 is a perspective diagram of another embodiment of the invention showing protruding truncated spheres 70 on the second interfacial surface 29. They may also be arranged in a concentric circular pattern with at least two circles. Preferably the truncated spheres 70 are ill-aligned with the protruding nodules 40 forming gaps 30 in between them. The spheres, it is believed, cleat the superhard material less and thus this embodiment has increased distortion. FIG. 8 is a perspective diagram of another embodiment of the invention showing protruding truncated elliptical knobs 72. The second interfacial surface 29 comprises protruding truncated elliptical knobs preferably formed in inner and outer concentric circles. It is believed that this design also balances the need for stiffness and some compliance in the substrate-superhard layer interface to increase wear life of the cutting element.

Figure 9:
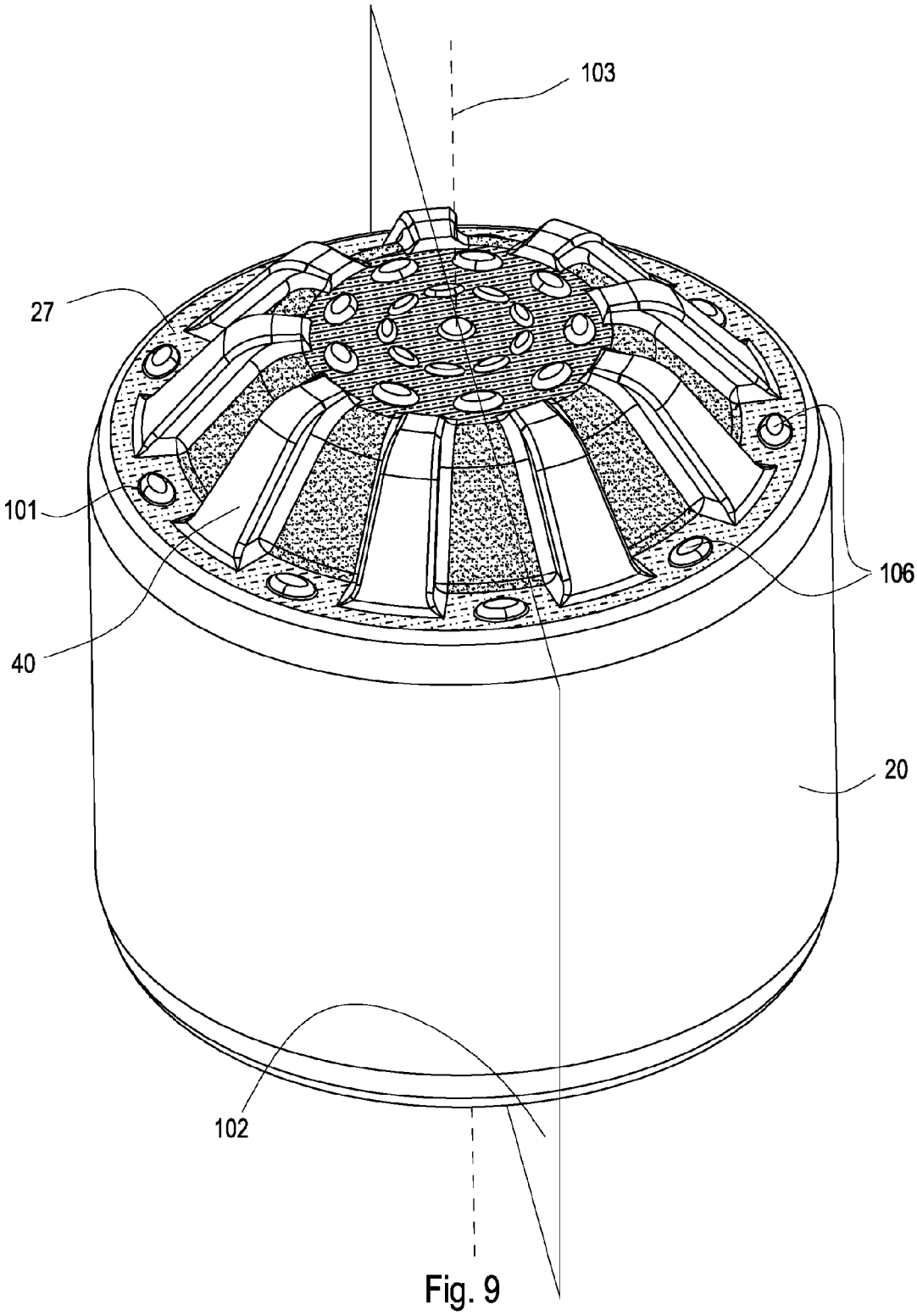
FIG. 9 is a perspective diagram of a substrate with plurality of protruding segments on a first surface.

FIG. 9 is a perspective diagram of a substrate 20 with a plurality of protruding segments 100 on a first surface 27. The protruding segments 100 may be ill-aligned, spherical, elliptical and/or conical. It may also be desirable for a transition between the protruding segments 100 and the first surface 27 to comprise a concave curve 101 so as to reduce stress risers. Also shown in FIG. 9 is a plane 102 intersecting the substrate 20 through its center 103 and only a signal truncated nodule 40. It may be desirable for only one truncated nodule 40 to be on a plane 102 with the center axis 103 to help direct and/or angular radial forces.

Whereas the present invention has been described in particular relation to the drawings attached hereto, it should be understood that other and further modifications apart from those shown or suggested herein, may be made within the scope and spirit of the present invention.

What is claimed is:

1. An improved cutting element substrate having a cant intersecting a first and second interfacial surface, wherein the improvement, comprises:

the cant comprising a plurality of truncated nodules intersecting the first surface and extending towards the second surface, and;

the second surface further comprising a plurality of radially positioned protruding arcuate segments, such that;

the arcuate segments proximate the truncated nodules are ill-aligned with each other.

2. The cutting element substrate of claim 1 wherein the second surface comprises at least two concentric arcuate segment circles.

3. The cutting element substrate of claim 2 wherein the arcuate segments in each concentric circle are ill-aligned.

4. The cutting element substrate of claim 1 wherein the second surface comprises a plurality of radially positioned protruding truncated spheres.

5. The cutting element substrate of claim 1 wherein the second surface comprises a plurality of radially positioned protruding truncated elliptical knobs.

6. The cutting element substrate of claim 1 wherein substrate is made from the group consisting of cemented metal-carbide, tungsten carbide, silicon carbide, titanium carbide, and cubic boron nitride.

7. The cutting element substrate of claim 1 wherein the substrate is substantially cylindrical, conical, or elliptical.

8. The cutting element substrate of claim 1, wherein the substrate is bound to a superhard material.

9. The cutting element substrate of claim 1, wherein the first surface comprises a plurality of protruding segments ill-aligned with the truncated nodules.

10. The cutting element substrate of claim 1, wherein the truncated nodules extend beyond the second surface.

11. The cutting element substrate of claim 1, wherein a plane intersects a single nodule and a central axis of the substrate.

12. The cutting element substrate of claim 1, wherein a transition between the cant and the truncated nodule comprises a concave curve.

13. The cutting element substrate of claim 1, wherein the truncated nodules are equidistant from each other.

14. The cutting element substrate of claim 1, wherein a transition from the cant to the truncated nodule comprises a concave curve.

15. The cutting element substrate of claim 1, wherein the cant comprises a slight curvature.

16. The cutting element of substrate claim 1, wherein the second interfacial surface comprises an apex formed substantially at the center of the substrate.

17. The cutting element of substrate claim 1, wherein the interfacial surfaces are adapted to resist a radial force.

18. The cutting element of substrate claim 1, wherein the interfacial surfaces are adapted to resist an angular force.

* * * * *